US006000978A

United States Patent [19]

Donahue

[11] Patent Number: 6,000,978

[45] Date of Patent: Dec. 14, 1999

[54] PROPULSION DEVICE FOR SNORKEL BOARD

[76] Inventor: Christopher Donahue, 8124 155th Pl. North, Palm Beach Gardens, Fla. 33418

[21] Appl. No.: 09/264,414

[22] Filed: Mar. 8, 1999

Related U.S. Application Data

[63] Continuation-in-part of application No. 09/218,354, Dec. 22, 1998

[60] Provisional application No. 60/068,537, Dec. 23, 1997.

[51] Int. Cl.[6] ..... B60L 11/02

[52] U.S. Cl. ..... 440/6; 114/315

[58] Field of Search ..... 440/6; 114/315

[56] References Cited

U.S. PATENT DOCUMENTS 5,105,753 4/1992 Chih et al. ..... 114/315

5,388,543 2/1995 Ditchfield ..... 114/315

*Primary Examiner*—Jesus D. Sotelo

*Attorney, Agent, or Firm*—Greensfelder, Hemker & Gale, P.C.

[57] ABSTRACT

The invention comprises a propulsion system attachment for use with a flotation board adapted with a mounting plug. The propulsion system comprises a shell housing which is adapted to be removably attached to a mounting plug member provided on the flotation board, a propeller motor, a power supply for the motor, and a remote control for operating the speed of the motor. The propulsion system also comes equipped with an air bag for maintaining buoyancy to the flotation board and to support the weight of the snorkeler. The air bag is provided with an air line so that the snorkeler can inflate and deflate as necessary to effect the proper buoyancy level. The snorkel board has handles for the user to grasp to aid in maneuvering the board. A supplemental air bag may be disposed underneath the rear of the snorkel board to help provide additional buoyancy to the board in the water.

16 Claims, 10 Drawing Sheets

PROPULSION DEVICE FOR SNORKEL BOARD

This application is a continuation-in-part of U.S. application No. 09/218,354, filed Dec. 22, 1998, which claims the priority benefit of U.S. Provisional Application No. 60/068,537, filed Dec. 23, 1997.

BACKGROUND OF THE INVENTION

The present invention relates to an underwater propulsion system attachment which can be employed in various aquatic applications, and in particular, with a flotation board used while snorkeling. In my prior co-pending application, a propulsion system unit for attachment on to a scuba air tank was described, which also had applicability to serve as an independent, hand-held propulsion system without being connected to the scuba air tank. The present invention applies that same propulsion system unit for ready attachment to a flotation board which may be used while snorkeling, or for just propelling along the surface of the water.

Snorkelers spend a considerable amount of time at the surface of the water, skimming along from one interesting spot to the next. While fascination for the snorkeler lies below the surface, much time is spent at, or near, the surface so that one can breathe. Also, the snorkeler needs to surface often to maintain his directional bearings. Further, in deeper water, the snorkeler must tread water at the surface if he wants to rest. This can get quite tiresome as there are very few practical items to help the snorkeler stay buoyant or afloat that do not also hinder the snorkeler's ability to dive. Oftentimes, a snorkeler must swim a considerable distance to get to the desirable snorkeling spot, and this can quickly add to fatigue. It would therefore be a great advantage to provide a device for the snorkeler which not only provides a source of ready flotation, but to also provides a source of propulsion to quickly get from one spot to the next without the expenditure of energy by the snorkeler.

SUMMARY OF THE INVENTION

This invention provides a propulsion system for mounting on a flotation board for use by a snorkeler or other water enthusiast. The propulsion system comprises a shell housing which is adapted to be removably attached to a mounting plug member provided on the flotation board, a propeller motor mounted on the shell housing, a power supply for the motor, and a remote control for operating the speed of the motor. The propulsion system is attached to the mounting plug of the flotation board using quick connect/disconnect buckles to enable easy installation and removal. The remote control, connected to the motor by a water-proof cord, allows the snorkeler to turn the unit on and off and to control the speed of the motor. The propulsion system also comes equipped with an air bag for maintaining buoyancy to the flotation board and to support the weight of the snorkeler. The air bag is provided with an air line so that the snorkeler can inflate and deflate as necessary to effect the proper buoyancy level. The snorkel board may optionally come with an underwater viewing window. The snorkel board has handles for the user to grasp to aid in maneuvering the board. A supplemental air bag may be disposed underneath the rear of the snorkel board to help provide buoyancy to level the board in the water, as much of the user's weight will tend to be placed rearwardly which can cause the board to tilt.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
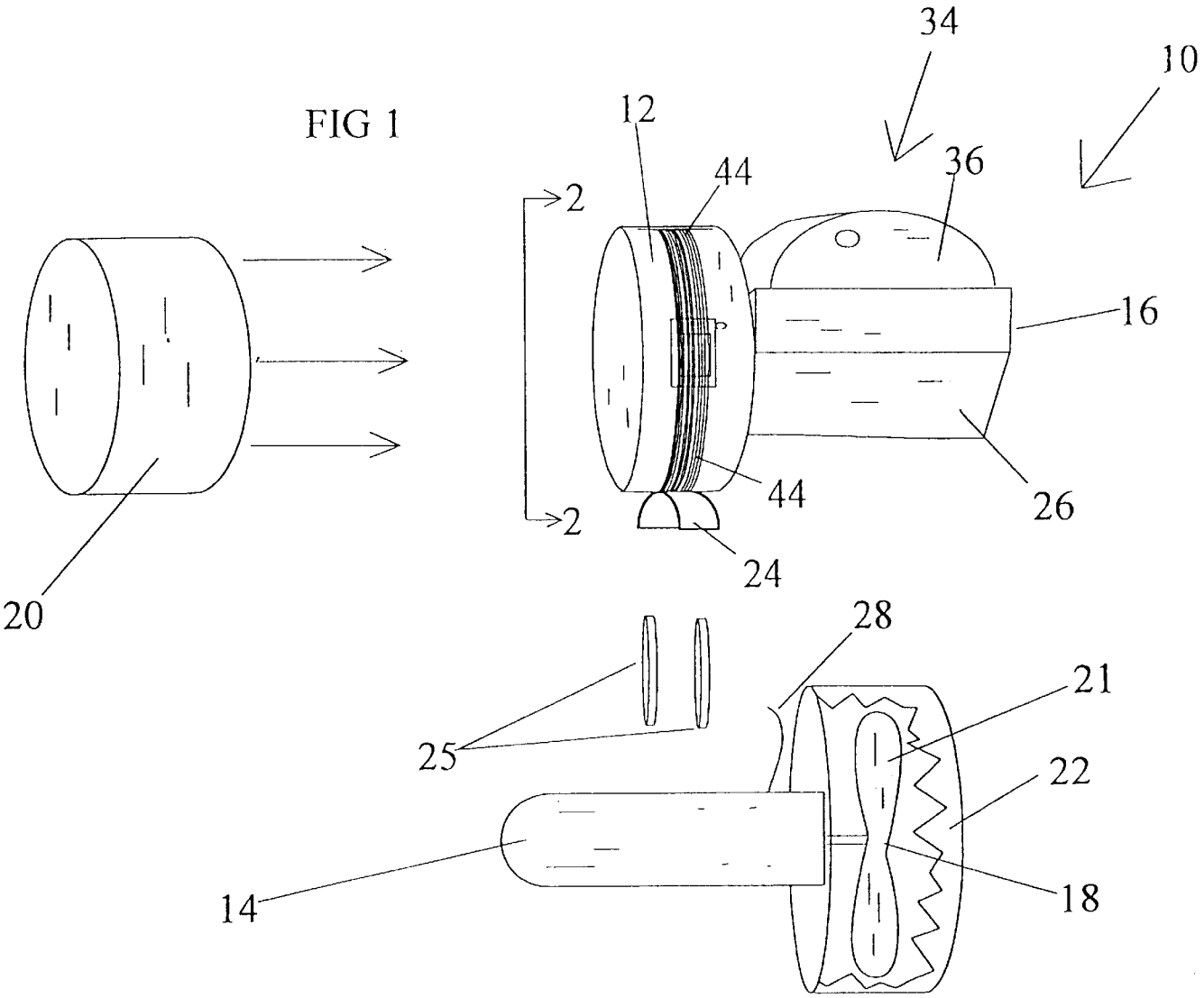
FIG. 1 is a partially exploded perspective view of the propulsion system unit with some elements partially broken, showing its capability of receiving a plug member.

The propulsion system attachment of the present invention is referred to generally by the reference numeral 10 as shown in FIG. 1. It comprises basically a shell, or boot member, 12 for receiving a mounting plug member 20, a motor 14, and a power supply 16. The motor 14 and power supply 16 are optimally each attached to the boot housing 12. Motor 14 is disposed adjacently to boot housing shell 12 such that propeller 18 trails behind and to the side of boot 12. A propeller guard 22, shown partially broken away in FIG. 1, is placed around the propeller blades 21 for protection. The motor may be a standard electrical or fuel powered motor/propeller of the type which is commonly available in marine shops. A U-shaped mounting support member 24, connected to boot housing shell 12 as shown in the exploded view of FIG. 1, is used to support motor 14 on to boot housing 12. Ring clamps 25 are provided to secure the motor body to the U-shaped support member. Power supply compartment 26 is fastened by bolting or riveting to the rear of boot housing shell 12, and receives therein a power supply such as a battery.

Figure 5:
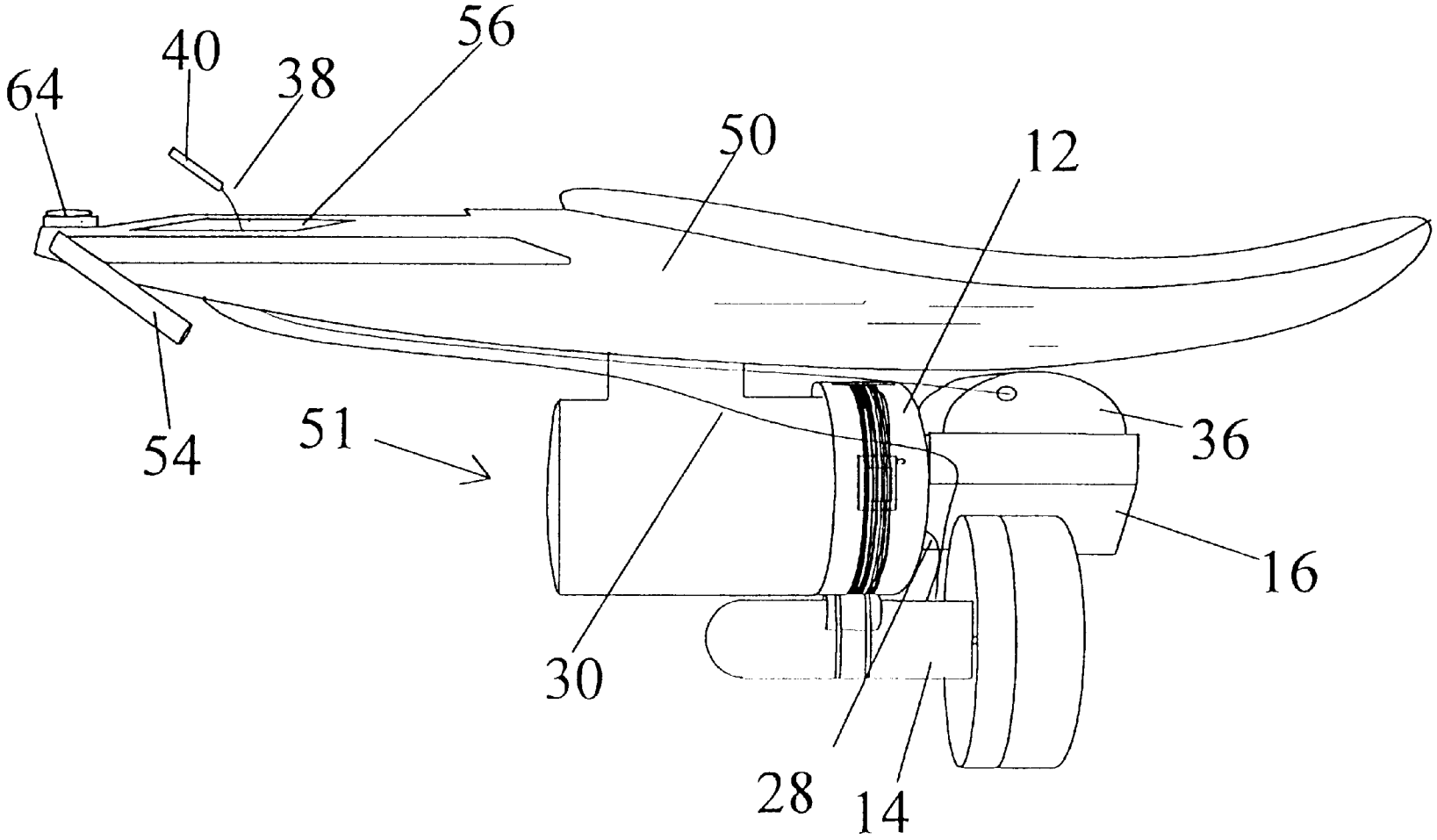
FIG. 5 is a view in side elevation of the propulsion unit attached to the flotation board.
Figure 6:
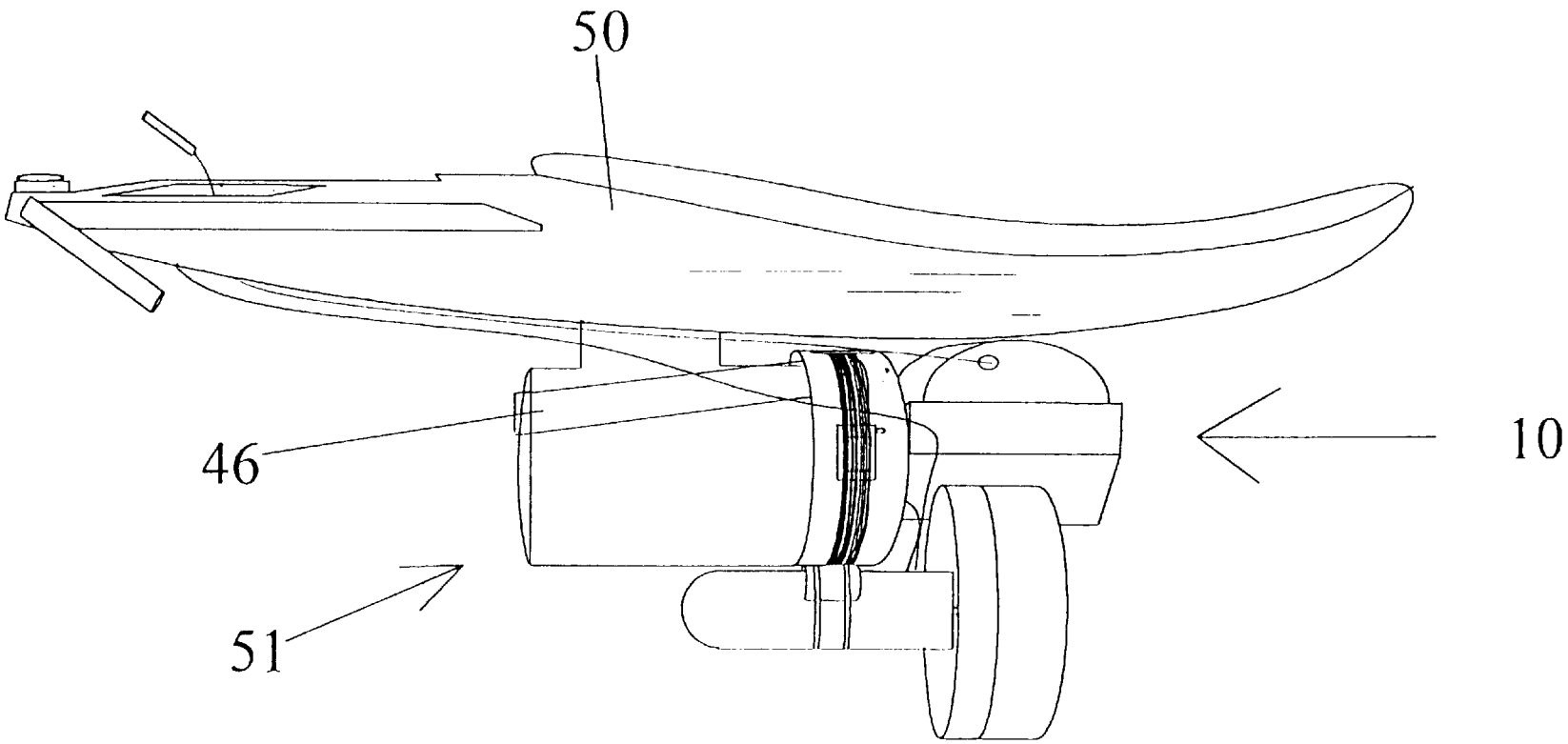
FIG. 6 is another view in side elevation of the propulsion unit attached to the flotation board.

The motor 14 receives power from the battery power supply through electrical cord 28 as shown in FIGS. 1, 5 and 6 using a waterproof connector plug. Power control cord 30 leading from the motor terminates in a remote control terminal 32. The remote control terminal 32 is equipped with circuitry for on-off and speed control functions, as is understood by those skilled in the art.

The propulsion system unit may further be provided with a buoyancy device 34. This device comprises an air bag 36 disposed adjacently the power supply compartment 26 and behind boot shell housing 12. An air line 38 enables the snorkeler to blow into the air line through a mouthpiece 40 to inflate air bag 36 to effect an increased buoyancy to the propulsion unit. Release valves (not shown) are provided in line 38 to deflate the air bag when necessary. When inflated, air bag 36 also serves as padding to cushion the propulsion unit from jarring contact from the flotation board in rough or choppy water.

Figure 2:
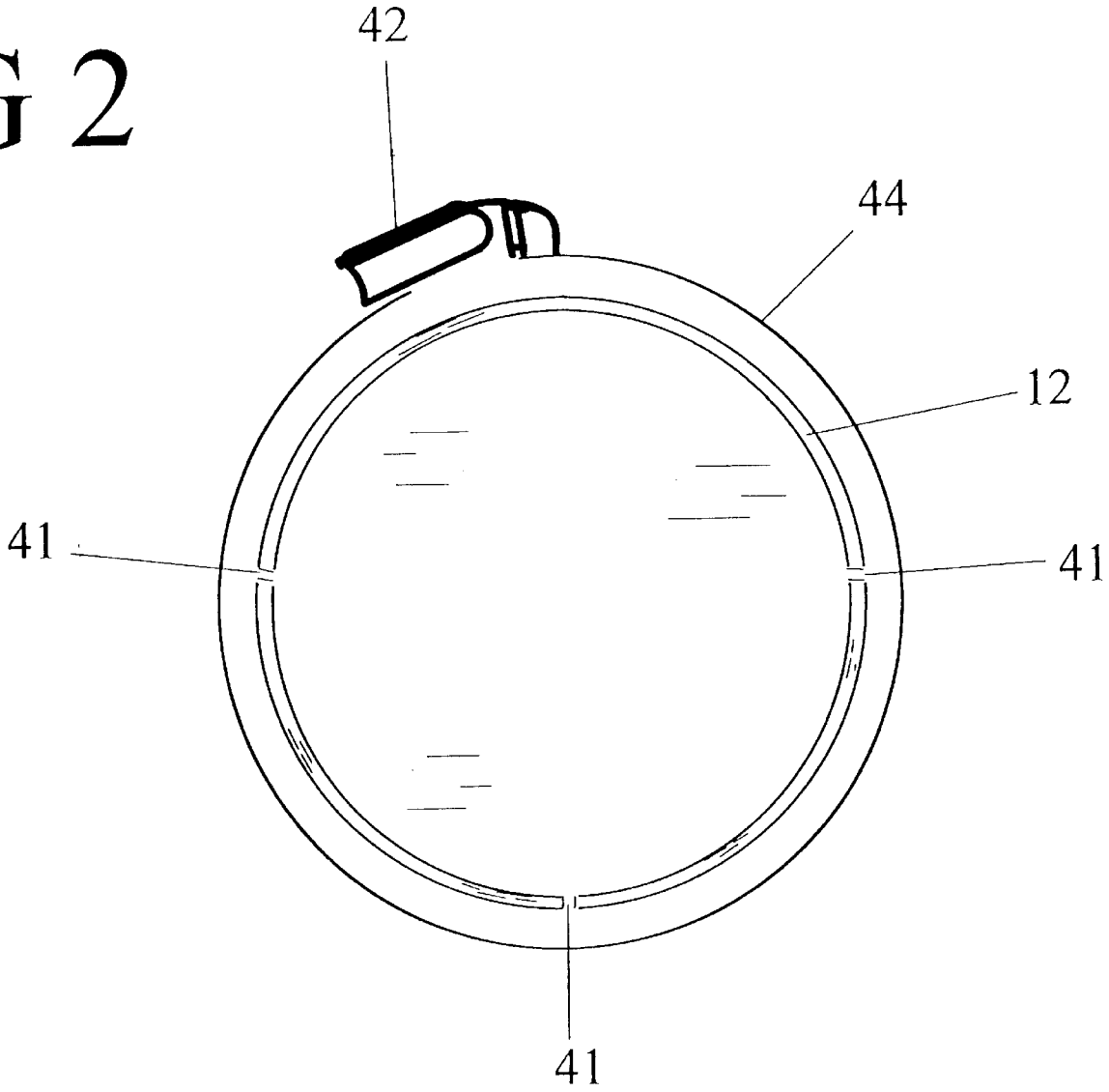
FIG. 2 is a view in side elevation taken along the lines 2—2 in FIG. 1 showing the interior of the mounting plug receiving boot member.

The boot housing 12 is cylindrical and cup-shaped to receive a similarly shaped cylindrical mounting plug member 20 as shown in FIG. 1. Boot member 12 is composed of plastic or other material which is sturdy yet light in weight. It is necessary to ensure a snug fit of the mounting plug member within the boot housing to prevent dislodgement of the propulsion unit during use. As shown in FIG. 2, boot member 12 can be provided with one or more gaps, or slits, 41 which allows the housing to be expanded to easily receive the mounting plug member. If only one slit is employed in the housing, it may be provided with a closing mechanism 42, such as a cam lock or snap buckle, to tighten the boot housing wall around the mounting plug member. Where multiple gaps are placed in boot housing 12, an encircling closure strap 44 may be employed around the circumference of boot housing shell 12 to draw the housing wall tightly around the mounting plug member as shown in FIG. 1. As a further means to ensure a secure attachment to the mounting plug member 20, a cinch strap 46 is provided on housing shell 12. Strap 46 is of sufficient length to wrap around the mounting plug attachment on the flotation board as shown in FIG. 6.

Propulsion unit 10 is thus adaptable as an attachment to a flotation board 50 configured with a mounting structure having a mounting plug member 52. Flotation board 50 is formed of plastic and may be manufactured in various ways known to those skilled in the art, such as injection or blow molding. The board optimally has a dimension sufficient to accommodate at least the upper torso, mid-section and thigh area of a user's body. Accordingly, it may have a dimension of around two to three feet wide and three to four feet long, but the size may vary. The board may be manufactured in various shapes, and may be flat or can have a slight curvature as shown in the drawings. Padding 60 may be provided on the top surface for user comfort. Handlebars 54 are attached at a forward end of board 50 for the user to grasp while riding. A viewing window 56 may optionally be formed in and through the flotation board.

Figure 3:
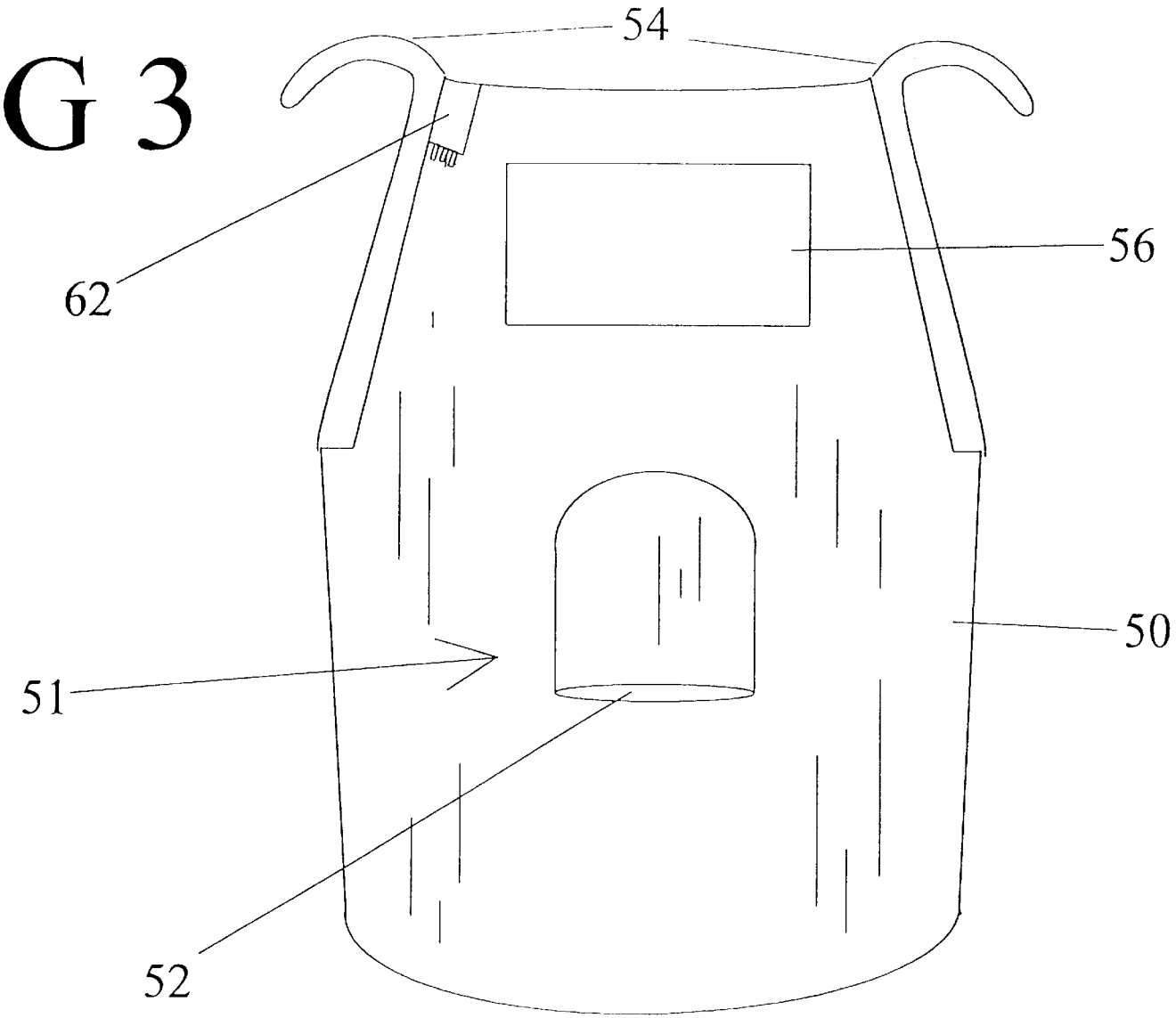
FIG. 3 is a plan view of the underneath side of the flotation board.
Figure 4:
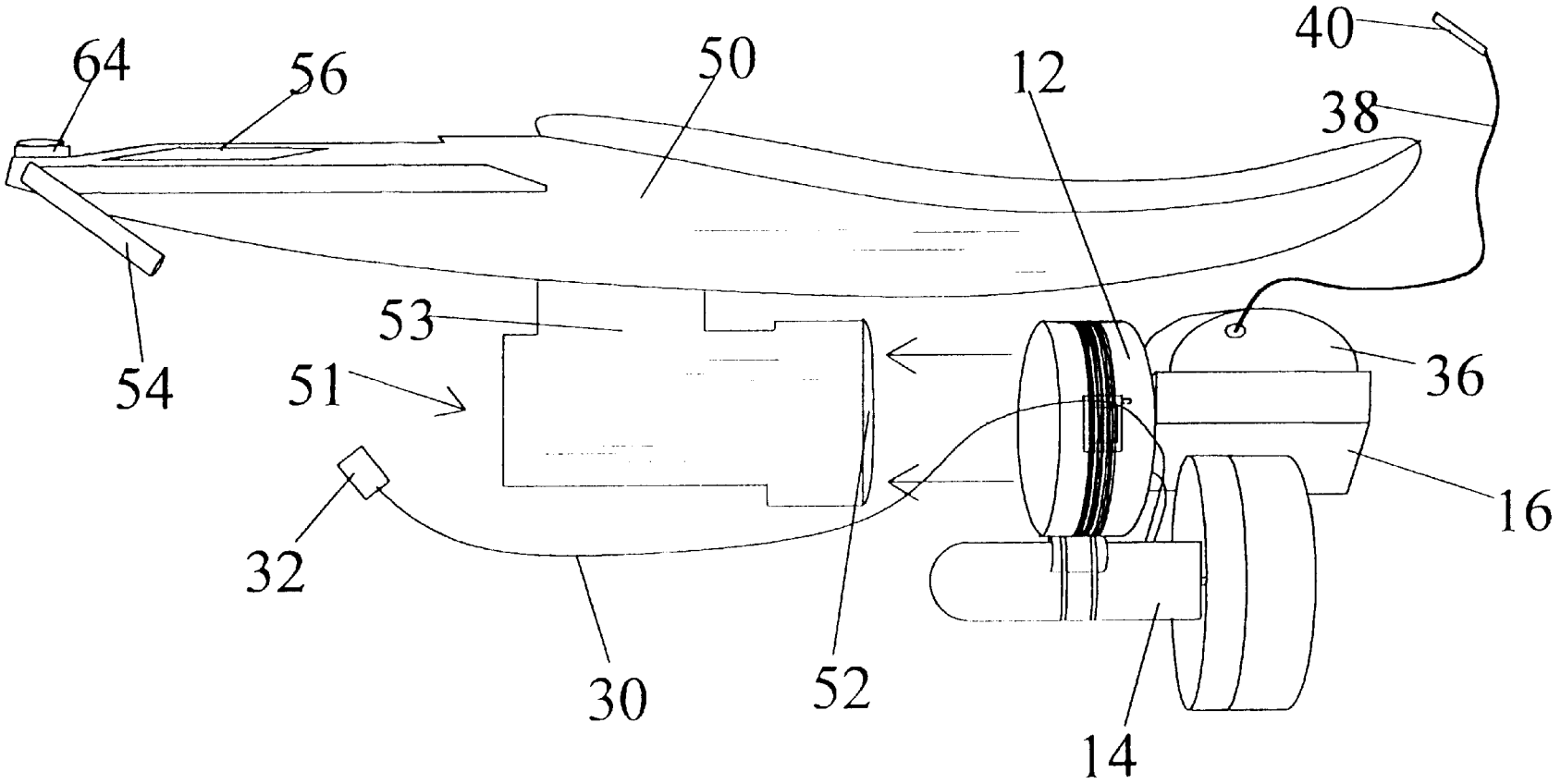
FIG. 4 is a view in side elevation of the propulsion unit and the flotation board, with the propulsion unit in preparation of being attached to the flotation board.
Figure 7:
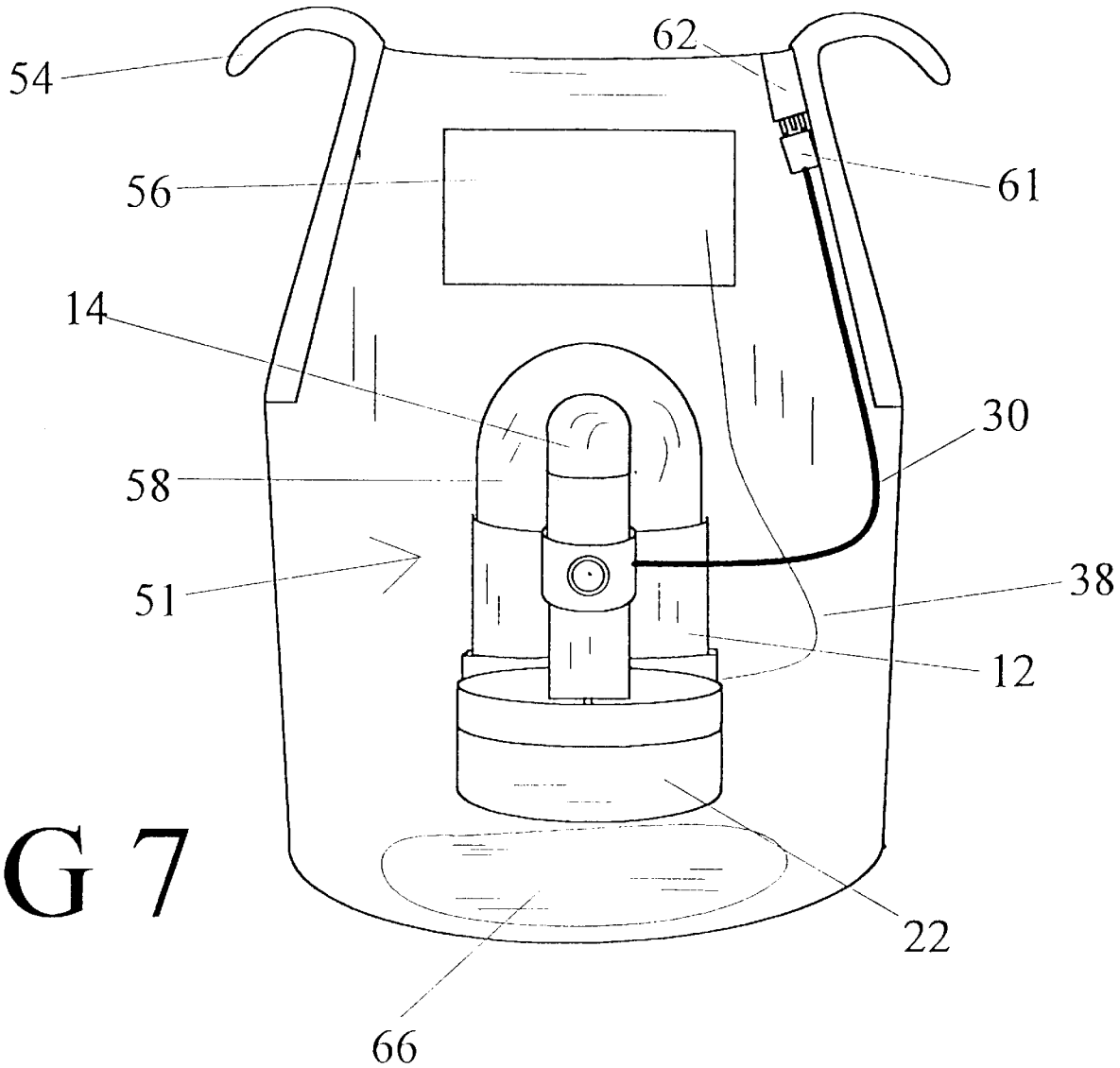
FIG. 7 is a plan view of the underneath side of the flotation board with the propulsion unit attached.
Figure 8:
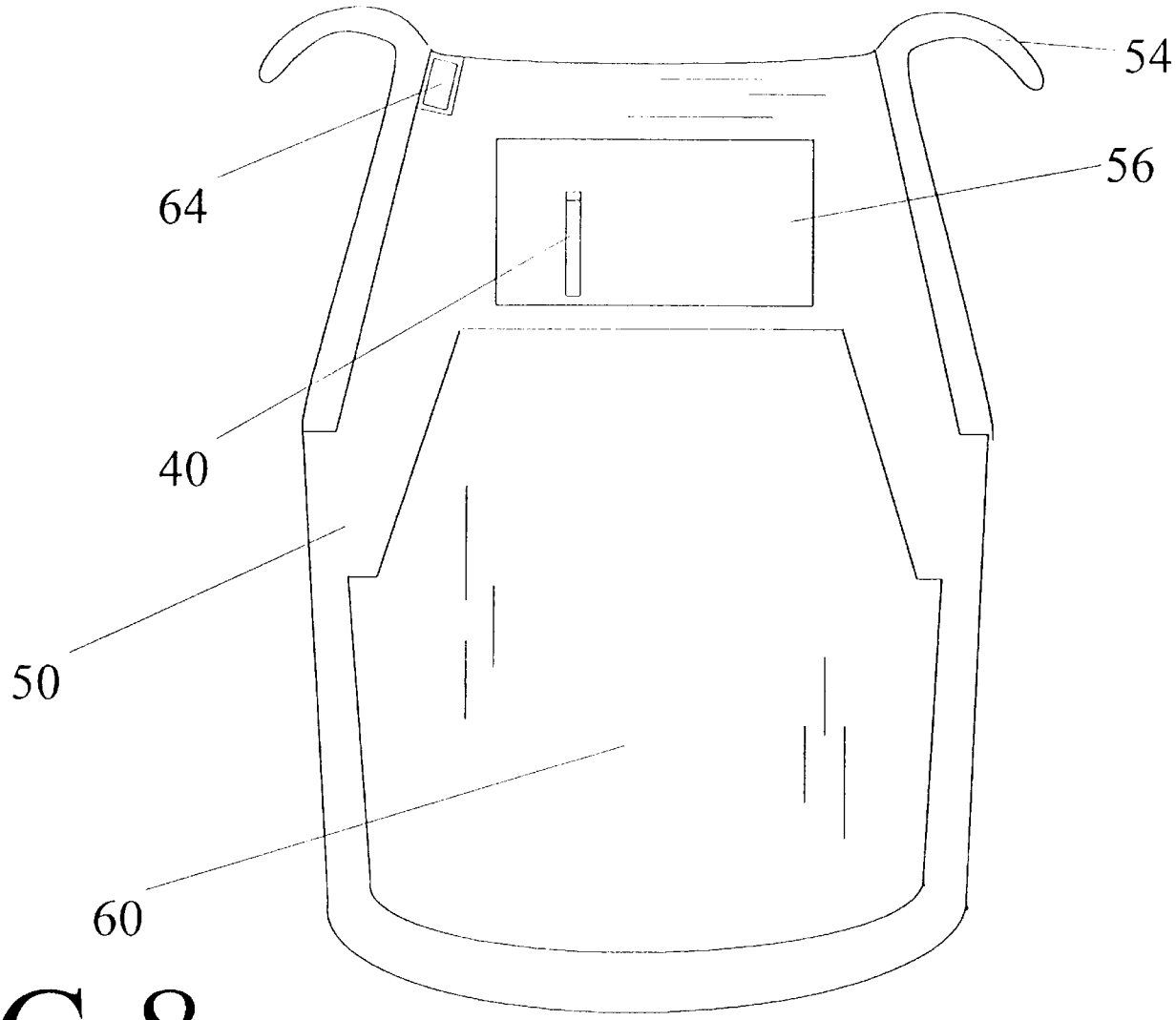
FIG. 8 is a plan view of the top side of the flotation board.

Propulsion system mount 51 is connected to the underneath side of board 50 as shown in FIG. 4. It is comprised of an L-shaped support post 53 having a rear end forming cylindrical mounting plug member 52. It is to be understood that other configuration shapes of the housing shell 12 and mounting plug 52 may be employed, such as triangular or other polygonal shape. Mount 51 allows the propulsion system to be slightly offset from the bottom surface of flotation board 50. The front end 58 of mount 51 may be bullet-shaped to resist drag during underwater propulsion. The remote control terminal 32 on power control cord 30 may hang freely on top of the board or may be connected onto the underneath side of flotation board 50 as shown in FIG. 7. The flotation board may even come with the remote control unit already integrally formed therein, at either the right or left handlebar region, so that power control cord 30 need only come with an adapter plug 61 for ready insertion into the remote control socket 62 as shown in FIG. 3. The remote control unit has a speed switch 64 which emerges on the top side of flotation board as shown in FIG. 8. For safety, this switch may be electrically configured such that when the user's finger comes off the switch, electrical power to the motor is shut off. This prevents the flotation board from accidentally propelling away without the user. Air line 38, for inflating air bag 36, may hang freely or may be connected to flotation board by clips or the like, so that mouthpiece 40 is accessible to the user. The air line may be fed up through viewing window 56 so that the mouthpiece can be in easy reach of the user as shown in FIG. 5. A second air bag 66 may be attached to the underneath rear portion of flotation board 50, as shown in FIG. 7, as an additional source of buoyancy to counteract the weight of the user's lower body. An air line similar to that for air bag 36 may be provided with air bag 66 for selective inflation and deflation.

Figure 9:
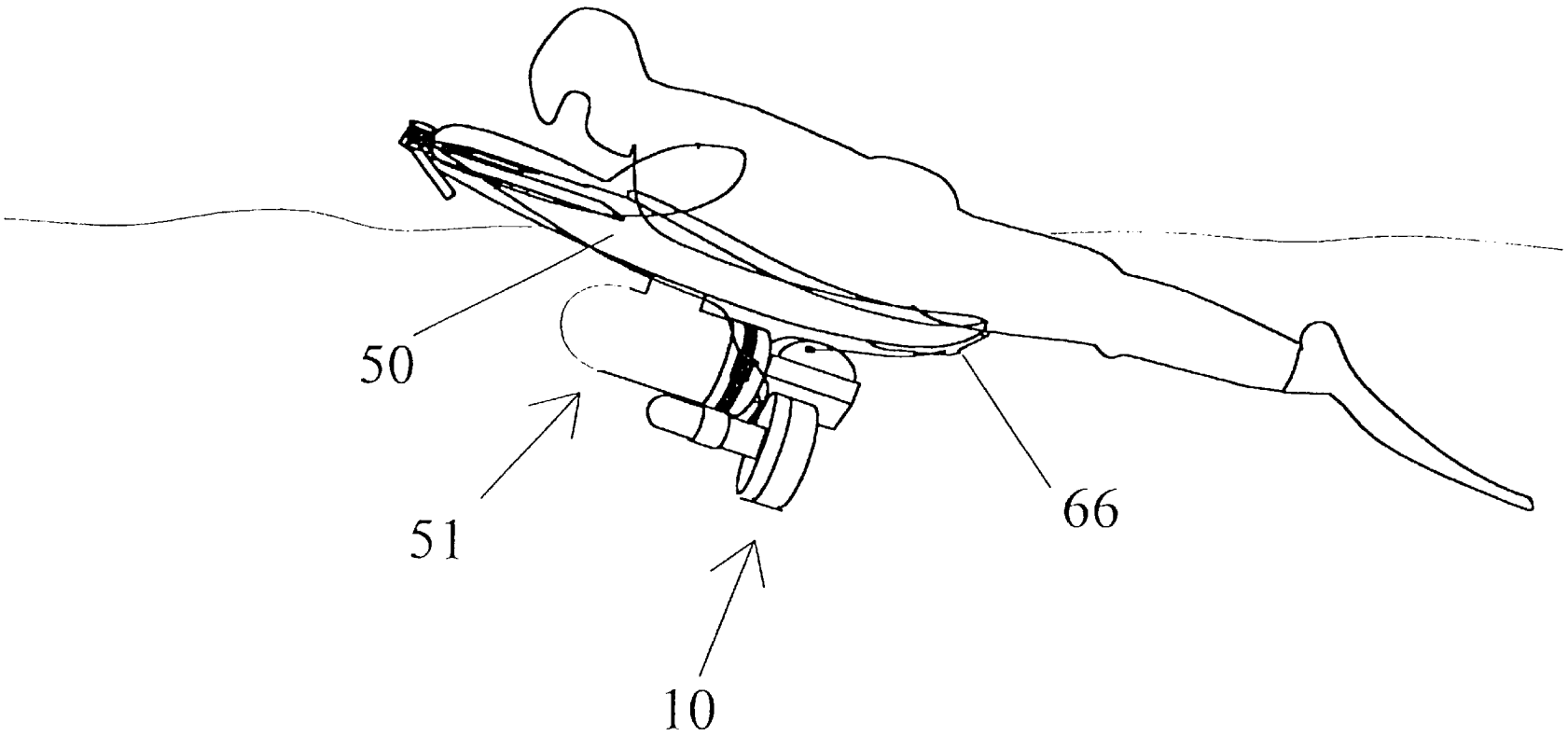
FIG. 9 is a perspective view of a person riding the flotation board.
Figure 10:
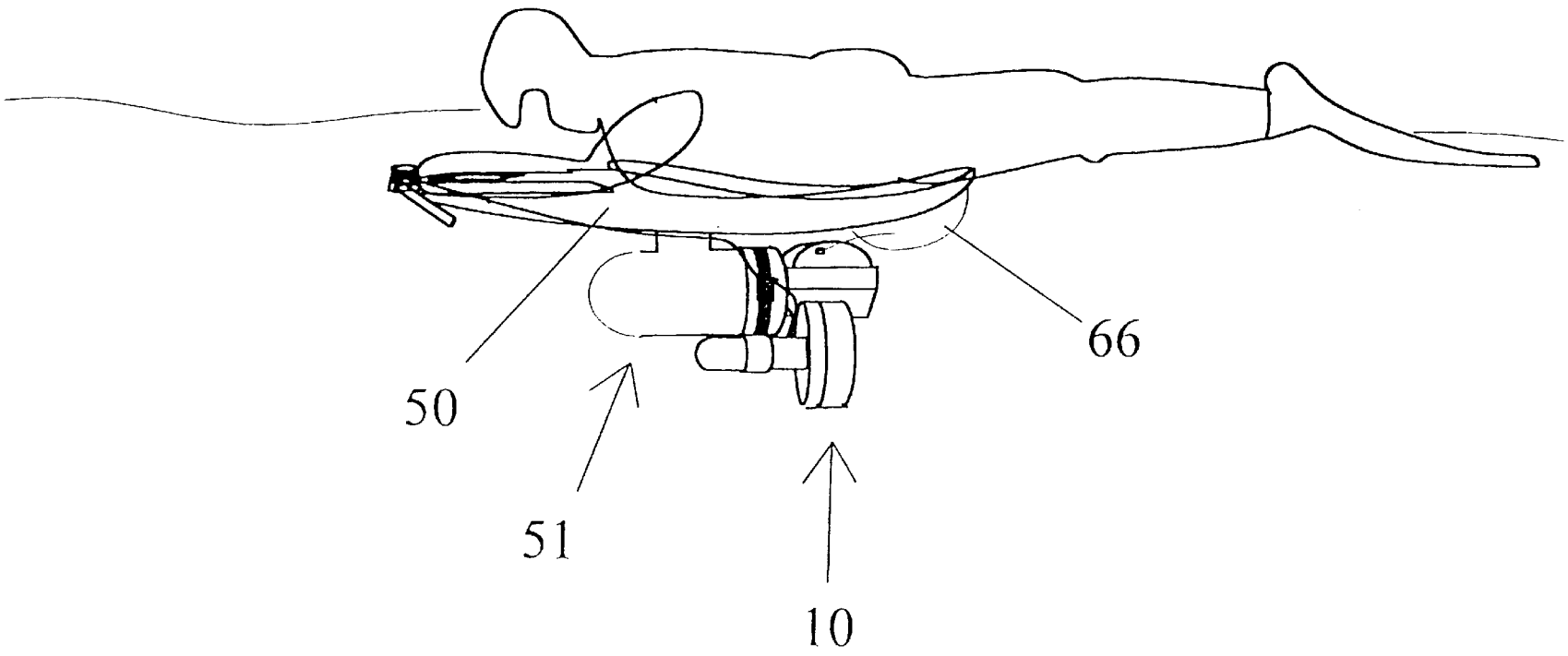
FIG. 10 is a perspective view of a person riding the flotation board, with the supplemental air bag inflated.

The propulsion unit is very simply attached to a floatation board modified with a mounting post in the manner disclosed herein to provide a self-propelled snorkel board. Boot member 12 is placed over mounting plug member 52 and secured down by closure strap 44. For further security, cinch strap 46 is used to draw the propulsion unit tight against mount 51, as shown in FIG. 6. Plug 61 of power cord 30 is connected to remote control socket 62 as shown in FIG. 7. Air bag 36 is inflated as necessary to provide buoyancy to the flotation board. As a snorkeler mounts the flotation board, his central and lower body weight may tend to dip the rear end of the board down as shown in FIG. 9. To counteract this, air bag 66 is inflated as necessary to provide an additional source of buoyancy to the rear of the board to help level it out, as shown in FIG. 10.

While the propulsion unit has been described as an attachment for a separate flotation board, it is to be understood that the propulsion unit and floatation board can be made to be an integral unit. Further, while the use of the propulsion system/flotation board has been described for use with snorkeling, it obviously has broader application and can be used for various water activities.

Various changes and modifications may be made within this invention as will be apparent to those skilled in the art. Such changes and modifications are within the scope and teaching of this invention as defined in the claims appended hereto.

What is claimed is:

1. A propulsion system attachment for mounting on a flotation board on which a person may ride, said propulsion system attachment comprising:

a propeller motor, a power supply for said motor, a motor power control, and a mounting plug receiving boot member, said propeller motor being mounted to said mounting plug receiving boot member, said propulsion system attachment being adapted to be mounted on a flotation board of a type having an external cylindrical mounting plug member attached at an underneath side thereof, said mounting plug receiving boot member being adapted to receive said mounting plug member to enable said propulsion system to be mounted to said flotation board, said motor power control adapted to regulate said propeller motor to effect propulsive movement to said flotation board along a surface of water.

2. The propulsion system attachment of claim 1 in which said mounting plug receiving boot member comprises a cylindrical shell, at least one slit being disposed in a wall of said shell such that said shell is capable of being slightly pulled apart to be able to receive said mounting plug therein, said shell having a quick connect buckle to enable said wall of said shell to be tightly drawn around said mounting plug in tight engagement.

3. The propulsion system attachment of claim 1 in which a buoyancy bag member is provided, said bag member being disposed on said propulsion system attachment such that it is capable of being positioned between said motor and said flotation board when said propulsion system is mounted under said flotation board, whereby an enhanced buoyancy effect is capable of being imparted to said flotation board.

4. The propulsion system attachment of claim 3 in which said buoyancy bag member is adapted to be selectively inflated and deflated.

5. The propulsion system attachment of claim 1 in which a cinch strap is provided on said mounting plug receiving boot member, said cinch strap being adapted to engage said mounting plug on said flotation board to maintain a secure attachment of said propulsion system to said flotation board.

6. A personal propulsion system for use on a surface of water, said propulsion system comprising:

a flotation board, a propeller motor, a power supply for said motor, a motor control, and a buoyancy bag member, said propeller motor being mounted to said flotation board at an underneath side thereof, said motor control being adapted to regulate said propeller motor to effect propulsive movement of said flotation board along said water surface, said bag member being disposed between said motor and said flotation board, whereby an enhanced buoyancy effect is capable of being imparted to said flotation board, said flotation board being of sufficient dimension to accommodate a user's body, and further having handle members whereby said user may ride on top of said flotation board.

7. The personal propulsion system of claim 6 in which said buoyancy bag member is adapted to be selectively inflated and deflated.

8. The personal propulsion system of claim 6 in which a second buoyancy bag member is disposed underneath said flotation board at a rear end thereof.

9. The personal propulsion system of claim 6 in which said motor control comprises a power cord in electrical communication with said motor, said power cord terminating in a remote control switch mounted on said flotation board in near proximity to said handle members, whereby said user is able to control operation of said motor by manipulation of said switch.

10. The propulsion system of claim 6 in which said flotation board has a window opening disposed therein.

11. The propulsion system of claim 6 in which said flotation board has a mounting plug member disposed at an underneath side thereof, and said motor has a plug receiving boot member, said mounting plug member being removably receivable within said boot member, whereby said motor is removable from said flotation board.

12. A personal propulsion system for use on a surface of water, said propulsion system comprising:

a flotation board, a propeller motor, a power supply for said motor, and a motor control, said propeller motor being mounted to said flotation board at an underneath side thereof, said motor control being adapted to regulate said propeller motor to effect propulsive movement of said flotation board along said water surface, said flotation board having a mounting plug member disposed at an underneath side thereof, said motor having a plug receiving boot member, said mounting plug member being removeably receivable within said boot member, whereby said motor is removable from said flotation board, said flotation board being of sufficient dimension to accommodate a user's body, and further having handle members whereby said user may ride on top of said flotation board.

13. The propulsion system attachment of claim 12 in which said mounting plug receiving boot member comprises a cylindrical shell, at least one slit being disposed in a wall of said shell such that said shell is capable of being slightly pulled apart to be able to receive said mounting plug therein, said shell having a quick connect buckle to enable said wall of said shell to be tightly drawn around said mounting plug in tight engagement.

14. The propulsion system attachment of claim 12 in which a cinch strap is provided on said mounting plug receiving boot member, said cinch strap being adapted to engage said mounting plug on said flotation board to maintain a secure attachment of said propulsion system to said flotation board.

15. A flotation board adapted for receiving a propulsion system, said flotation board having:

a mounting plug disposed on an underneath side thereof for receiving said propulsion system, handle members, a window opening, and a buoyancy bag member, said bag member being disposed underneath said flotation board, whereby an enhanced buoyancy effect is capable of being imparted to said flotation board.

16. The flotation board of claim 15 in which said buoyancy bag member is adapted to be selectively inflated and deflated.

* * * * *